United States Patent [19]

Asano et al.

[11] Patent Number: 4,568,568

[45] Date of Patent: Feb. 4, 1986

[54] CATHODE FOR ELECTROLYZING ACID SOLUTIONS AND PROCESS FOR PRODUCING THE SAME

[75] Inventors: Hiroshi Asano, Chiba; Takayuki Shimamune, Tokyo; Toshiki Goto; Masashi Hosonuma, both of Kanagawa, all of Japan

[73] Assignee: Permelec Electrode Ltd., Kanagawa, Japan

[21] Appl. No.: 688,204

[22] Filed: Jan. 3, 1985

Related U.S. Application Data

[60] Continuation of Ser. No. 508,650, Jun. 28, 1983, abandoned, which is a division of Ser. No. 416,512, Sep. 9, 1982, abandoned.

[30] Foreign Application Priority Data

Sep. 22, 1981 [JP] Japan ..... 56-148698

[51] Int. Cl.[4] ..... B05D 5/12

[52] U.S. Cl. ..... 427/125; 427/123; 427/126.5; 427/388.2; 427/407.1; 427/409; 427/404; 427/405; 427/419.2; 427/419.5; 427/419.7; 204/290 R; 204/290 F; 204/291

[58] Field of Search ..... 204/290 R, 290 F, 291; 427/123, 125, 126.5, 388.2, 407.1, 409, 404, 405, 419.2, 419.5, 419.7

[56] References Cited

U.S. PATENT DOCUMENTS

| | | | |
|---|---|---|---|
| 3,649,485 | 3/1972 | Chisholm | 204/95 |
| 3,798,063 | 3/1974 | Decraene | 204/290 R |
| 3,922,226 | 11/1975 | Entwisle | 204/290 F |
| 3,977,959 | 8/1976 | Habermann et al. | 204/290 R |
| 4,175,023 | 11/1979 | Argade et al. | 204/290 R |
| 4,294,628 | 10/1981 | Kasuya | 427/126.5 |
| 4,354,915 | 10/1982 | Stachurski et al. | 204/290 R |

FOREIGN PATENT DOCUMENTS 1415684 11/1975 United Kingdom .

*Primary Examiner*—Richard Bueker

*Attorney, Agent, or Firm*—Sughrue, Mion, Zinn Macpeak & Seas

[57] ABSTRACT

A cathode for electrolyzing acid solutions which comprises an electrically conductive metal substrate, a spray coated layer of a cathode active material containing tungsten, tungsten carbide or a mixture thereof in an amount of 10% by weight or more on the substrate, and an impregnation coated layer of 1 g/m$^2$ or more of an acid-resistant fluorine containing resin on the outside surface of the coated layer of cathode active material, and a process for producing such.

3 Claims, No Drawings

CATHODE FOR ELECTROLYZING ACID SOLUTIONS AND PROCESS FOR PRODUCING THE SAME

This is a continuation of application Ser. No. 508,650, filed 6/28/83, now abandoned, which is a division of application Ser. No. 416,512 filed 9/9/82, now abandoned.

FIELD OF THE INVENTION

The present invention relates to a cathode for electrolyzing acid solutions and, in greater detail, to a cathode having excellent durability in electrolysis of inorganic or organic acid solutions. The invention also relates to a process for producing the same, which comprises coating a metal substrate with a cathode active substance comprising tungsten or tungsten carbide as a main component by spray coating and impregnating such with an acid-resistant fluorine containing resin.

BACKGROUND OF THE INVENTION

Hitherto, graphite has been used conventionally as a cathode for electrolyzing acid electrolytes containing hydrochloric acid, sulfuric acid, nitric acid, an organic acid or a mixed acid thereof. Graphite is inexpensive and has excellent corrosion resistance and excellent resistance to hydrogen embrittlement. However, graphite has the disadvantage that it has not only a high electric potential for hydrogen generation and a comparatively low electric conductivity but also poor mechanical strength and processing properties. East German Pat. No. 62308 describes reducing the electrolysis voltage by using a cathode having a low hydrogen overvoltage which is prepared by coating graphite with tungsten carbide or titanium carbide by plasma spray coating. However, it is not possible to remove the disadvantages of graphite where it is used as a cathode substrate.

On the other hand, various kinds of cathodes wherein a substrate composed of a metal is coated with a material having a low hydrogen overvoltage are known. For example, a cathode for chlorine-alkali electrolysis wherein a substrate of iron metal is coated with a powdery metal having a low hydrogen overvoltage by flame spray coating is described in Japanese Patent Application (OPI) No. 32832/77. In this cathode, although mechanical strength and processing properties are improved because the substrate is made of metal, there are problems that resistance to corrosion is not sufficient for practical use where the cathode is used for electrolyzing the above-described acid solutions and because the catholyte is an alkaline solution for chlorine-alkali electrolysis.

SUMMARY OF THE INVENTION

The present invention provides the ability to overcome the above-described problems.

An object of the present invention is to provide a cathode for electrolysis which has excellent mechanical strength and processing properties, low hydrogen overvoltage characteristic and excellent durability for electrolysis of acid solutions.

Another object of the present invention is to provide a process for producing easily a cathode having these excellent electrode characteristics.

The cathode for electrolyzing acid solutions of the present invention comprises an electrically conductive metal substrate, a spray coated layer of a cathode active material containing tungsten, tungsten carbide or a mixture thereof provided on the substrate, and an impregnation coated layer of an acid-resistant fluorine containing resin provided on the outside surface part of the coated layer of the cathode active substance.

Further, the cathode of the present invention is produced by forming a coated layer on the electrically conductive metal substrate by spray coating of a powder of the above-described cathode active substance, impregnating the outside surface part of the coated layer with an acid-resistant fluorine containing resin so as to leave exposed portions of the cathode active substance, heating the thus-produced material and solidifying such.

DETAILED DESCRIPTION OF THE INVENTION

Various known materials can be used as the metal substrate in the present invention, if they have good electrical conductivity and good corrosion resistance. Ti, Ta, Nb, Zr and alloys comprising them as a main component such as Ti-Ta, Ti-Ta-Nb, etc., Ni and alloys thereof such as Ni-Cu (Trade name: Monel produced by INCO) and Ni-Mo (Trade name: Hastelloy produced by Mitsubishi Metal Corporation), etc., are particularly suitable for use. Since the substrate is a metal material, it is possible to process the metal material into a suitable shape such as that of a plate, a porous plate, a rod, a lattice or a mesh, etc.

Then, a cathode active substance comprising tungsten, tungsten carbide or a mixture thereof as a main component, e.g., in an about of 10 wt. % or more is applied to the metal substrate by spray coating to form a coated layer. By coating the substrate with tungsten or tungsten carbide which has low hydrogen overvoltage characteristics by spray coating, a suitably rough surface is formed on the substrate and the surface area thereof is increased, by which the cathode exhibits a further reduction in the electric potential of hydrogen generation. Further, tungsten or tungsten carbide has the effect of increasing the durability of the cathode, because each has excellent corrosion resistance and excellent resistance to hydrogen embrittlement in electrolysis of acid solutions and is durable for use for a long period of time while simultaneously protecting the metal substrate.

The cathode active substance to be applied by spray coating must contain about 10% by weight or more of tungsten, tungsten carbide or a mixture thereof in the coated composition. If the amount is lower than about 10% by weight, the cathode is not suitable for practical use, because sufficient effects can not be obtained from the standpoint of reduction of hydrogen overvoltage or durability. Commercially available tungsten or tungsten carbide powders for spray coating can be used to produce this coating. Generally, the tungsten carbide for spray coating contains substances for improving the sintering properties during spray coating, such as Ni, Cr, B, Si, Fe, C or Co, etc. Examples of suitable tungsten carbide compositions are shown in Table 1 below.

TABLE 1

| Composition No. | WC Powder for Spray Coating Component | | | | | | | |
|---|---|---|---|---|---|---|---|---|
| | WC | Co | Ni | Cr | B | Si | Fe | C |
| 1 | 70.4 | 9.6 | 14.0 | 3.5 | 0.8 | 0.8 | 0.8 | 0.1 |

TABLE 1-continued

| Composition No. | WC Powder for Spray Coating Component | | | | | | | |
|---|---|---|---|---|---|---|---|---|
| | WC | Co | Ni | Cr | B | Si | Fe | C |
| 2 | 44.0 | 6.0 | 36.0 | 8.5 | 1.65 | 1.95 | 1.5 | 0.45 |
| 3 | 30.8 | 42.0 | 46.0 | 11.0 | 2.5 | 2.5 | 2.5 | 0.5 |
| 4 | 88 | 12 | — | — | — | — | — | — |
| 5 | 83 | 17 | — | — | — | — | — | — |

Tungsten is commercially available on the market as a metal powder, which can be used alone or by blending in a suitable amount with a WC powder as described in Table 1 for spray coating. A suitable particle size for the powders can be about 5 to 100μ, preferably 10 to 50μ. In spray coating the cathode active substance, platinum group metals such as Pt, Ru, Ir, Pd and Rh or oxides thereof such as $RuO_2$, $IrO_2$, etc., may be added or applied. It is preferred for the amount of the above-described platinum metal or oxide thereof to be added to be about 0.01 to 10% by weight and the particle size thereof to be about 0.1μ to 0.1 mm. The addition or application of the platinum metals or oxides thereof markedly contributes to a reduction in hydrogen overvoltage, even if the platinum metal or oxides are used in a small amount. Further, it is possible to reduce the electric potential of hydrogen generation by about 0.2 to 0.5 V. Since these platinum metal and oxide materials are expensive and a sufficient effect is obtained when they are present on only the surface layer, it is preferred for the spray coating using the platinum metal substances to be carried out at the final stage. Further, they may be applied using means such as electroplating, chemical plating, dispersion plating, sputtering, evaporation, thermal decomposition or sintering, etc., after formation of the above-described W or WC spray coated layer.

The spray coated layer of W or WC and including the platinum group metal or oxide preferably has a thickness of about 0.02 to 0.5 mm, preferably 50 to 100μ, or so. If it is less than about 0.02 mm, desired properties can not be obtained because it becomes difficult to form a uniform coating layer on the substrate. Further, if it is more than about 0.5 mm, there is the possibility that cracks easily occur on the coated layer and this results in a deterioration in the corrosion resistance.

The spray coating can be carried out using flame spray coating or plasma spray coating, which can be carried out using conventionally available fusion spray coating apparatus for powders. The thus resulting spray coated material itself can be practically used as a cathode under mildly corrosive conditions, because the cathode characteristics and durability thereof are improved to some extent. However, it is generally inevitable that a spray coated layer with numerous fine openings is found, and the electrolyte permeates through the fine openings and corrodes the metal substrate in use with highly corrosive electrolytes, particularly, those having a pH of 5 or less. Hitherto, cathodes which are sufficiently durable in such electrolytes have not been obtained.

The present invention is based on the discovery that the durability of the cathode is greatly improved by applying an acid-resistant fluorine containing resin to the above-described spray coated layer by impregnation.

Suitable acid-resistant fluorine containing resins which can be used include various known resins, but it is preferred to use fluorine containing resins composed of tetrafluoroethylene, fluorochloroethylene or tetrafluoroethylene-hexafluoropropylene copolymer, etc.

By applying the acid-resistant fluorine containing resin to the spray coated layer by impregnation, the fine openings of the spray coating layer can be sealed, and thus the corrosion of the metal substrate due to permeation of the electrolyte can be prevented very well.

Further, it is necessary for the application of the above-described resin by impregnation to be carried out in such a manner that the fine openings are sufficiently sealed so as to leave exposed parts of the cathode active substance without completely covering the cathode active surface. The application by impregnation can be easily carried out by applying a suitable amount of a dispersion of the above-described fluorine containing resin to the spray coated layer by spraying or brushing and then heating at about 300° to 400° C. Further, the application of the fluorine containing resin by impregnation can be achieved using a plasma polymerization process, a plasma spray coating process, a vacuum evaporation process, an electrophoretic process or a process of merely rubbing the resin into the coated layer.

It is necessary to apply the above-described acid-resistant fluorine containing resin in an amount of about 1 $g/m^2$ or more to the outside surface part of the spray coating layer by impregnation. If the amount is less than about 1 $g/m^2$, the effect of improving the corrosion resistance is not sufficiently obtained, because consumption of the cathode rapidly increases. On the other hand, if the amount of the resin to be applied by impregnation is increased, the corrosion resistance is remarkably improved, but the area of the cathode active surface exposed decreases and the electric potential of hydrogen generation gradually increases. Accordingly, it is necessary to apply the fluorine containing resin in such an amount that exposed portions remain on the outside surface part of the cathode active substance as described above.

The cathode of the present invention can be used not only for unipolar systems but also in the cathode side of multipolar systems.

The following Examples are given to illustrate the invention in greater detail but the invention is not to be construed as being limited thereto.

EXAMPLE 1

To a titanium rod having a diameter of 3 mm and a length of 20 cm, a commercially available powder of tungsten carbide—12% cobalt (METCO 72F-NS) shown in Table 1 as Composition No. 4 was applied by plasma spray coating under the conditions shown in Table 2 below to form a spray coated layer having a thickness of 0.1 mm.

TABLE 2

| Conditions of Spray Coating of Tungsten Carbide | |
|---|---|
| Arc Electric Current | 500 A |
| Arc Electric Voltage | 75 V |
| Amount of Operating Gas Supplied | Ar 40 l/minute<br>$H_2$ 6 l/minute |
| Amount of Powder Supplied | 2.7 kg/hour |
| Distance of Spray Coating | 90 mm |

After the resulting spray coating material was immersed in a dispersion of tetrafluoroethylene resin for 1 minute, the material was heated at 330° C. for 30 minutes. The above-described dispersion was that prepared by adding 1 part of water to 1 part of Polyflon Dispersion D-1 (trade name, produced by Daikin Kogyo Co.; content of polymer: 60%). After heating, the amount of the resin applied by impregnation was about 10 g/m$^2$. When the distribution of elemental fluorine on the surface of the resulting sample was examined using a X-ray microanalyzer (Hitachi X-560), the outside surface was observed to be partially impregnated. As a result of measuring the electric potential at 25° C. in an aqueous solution of hydrochloric acid of a concentration of 150 g/l using the above-described sample as a cathode, the electric potential of hydrogen generation was 140 mV lower than that of a graphite electrode used similarly. Further, when electrolysis was carried out at 60° C. in an aqueous solution of hydrochloric acid of a concentration of 150 g/l at a current density of 0.5 A/cm$^2$ for 200 hours using the above-described cathode, no consumption of the cathode was observed at all. On the contrary, the amount of consumption of the cathode without impregnation of the resin was 60 g/m$^2$ under the same conditions as described above. Thus, it can be seen that the durability of the cathode of the present invention is remarkably improved.

EXAMPLE 2

To a nickel alloy plate (trade name: Hastelloy Mo 28%-Fe 5%-Ni balance) having a size of 30 mm×30 mm×2 mm, a commercially available tungsten powder (METCO 61-FNS) was applied by plasma spray coating under the conditions shown in Table 3 below to form a spray coated layer having a thickness of 0.1 mm.

TABLE 3

| Conditions of Spray Coating of Tungsten | |
|---|---|
| Arc Electric Current | 500 A |
| Arc Voltage | 7.5 V |
| Amount of Operating Gas Supplied | $N_2$ 40 l/minute |
| | $H_2$ 6 l/minute |
| Amount of Powder Supplied | 5 kg/hour |
| Distance of Spray Coating | 100 mm |

Then, tetrafluoroethylene resin was applied in an amount of 15 g/m$^2$ by impregnation using the same dispersion and process as in Example 1 to produce a cathode.

The electrical potential of this cathode at 25° C. in an aqueous solution of sulfuric acid of 130 g/l was 30 mV lower than that of a graphite electrode used similarly. Further, as a result of electrolysis at 50° C. in an aqueous solution of sulfuric acid of 150 g/l at a current density of 0.2 A/cm$^2$, no consumption of the cathode was observed after 1000 hours. By comparison, the amount of consumption of the cathode without the fluorine containing resin was 50 g/m$^2$.

EXAMPLE 3

A powder prepared by adding 5% by weight of ruthenium oxide having a particle size of about 2μ to 5μ to a tungsten powder for spray coating as described in Example 2 and sufficiently blending the mixture was applied to the same type of substrate as described in Example 2 by plasma spray coating under the same conditions as shown in Table 3 of Example 2 to form a spray coating layer having a thickness of 10μ. Further, a tetrafluoroethylene resin was applied in an amount of 5 g/cm$^2$ by impregnation using the same dispersion and process as in Example 1. As a result of carrying out the same measurement and electrolysis testing as in Example 2, the electric potential of hydrogen generation was 240 mV lower than that of graphite used similarly and no consumption of the cathode was observed at all. With the comparative cathode without the fluorine containing resin treatment, the amount of consumption was 40 g/m$^2$.

EXAMPLE 4

On a surface of a tungsten spray coated layer prepared in the same manner as in Example 2, a palladium coated layer of a thickness of about 1μ was formed by plating from a solution under the following conditions: palladium ammonium chloride; 6.25 g/l, ammonium chloride; 10 g/l, pH; 0.1–0.5 adjusted with hydrochloric acid, temperature; 25° C. and current density; 1 A/dm$^2$.

Then, a tetrafluoroethylene-hexafluoropropylene copolymer (about 1:1 on a molar basis) was applied in an amount of 10 g/m$^2$ by impregnation using the same process as in Example 1.

The electric potential of hydrogen generation of the resulting cathode under the same evaluation conditions as in Example 2 was 270 mV lower than that of graphite used similarly, and no consumption of the cathode was observed at all.

While the invention has been described in detail and with reference to specific embodiments thereof, it will be apparent to one skilled in the art that various changes and modifications can be made therein without departing from the spirit and scope thereof.

What is claimed is:

1. A process for producing a cathode for electrolyzing acid solutions which comprises:

forming a spray coated layer of a cathode active material on an electrically conductive metal substrate by spray coating a powder containing about 10% by weight or more of tungsten, tungsten carbide or a mixture thereof;

impregnating, without using pore forming agents, the outside surface area of the coated layer with an acid-resistant fluorine containing resin in an amount of about 1 g/m$^2$ or more so as to leave exposed portions of said cathode active material heating said material thus produced at a temperature of 300° to 400° C.; and solidifying said resin on said material.

2. A process according to claim 1, wherein said coating layer is formed by plasma spray coating or flame spray coating.

3. A process according to claim 1, wherein said process includes coating said spray coated layer with at least one platinum group metal or an oxide thereof.

* * * * *